US009734683B1

(12) United States Patent
Perez

(10) Patent No.: US 9,734,683 B1
(45) Date of Patent: Aug. 15, 2017

(54) MODULAR AND ADAPTABLE SENSOR SYSTEM WITH INTEGRATED LOCK

(71) Applicant: Sergio M. Perez, Lake Worth, FL (US)

(72) Inventor: Sergio M. Perez, Lake Worth, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/151,793

(22) Filed: May 11, 2016

(51) Int. Cl.
*G08B 13/14* (2006.01)
*G08B 13/24* (2006.01)

(52) U.S. Cl.
CPC ..... *G08B 13/2434* (2013.01)

(58) Field of Classification Search
CPC ..... G08B 13/2434
USPC ..... 340/572.1, 572.4, 572.9, 568.1; 235/382, 235/385, 492
See application file for complete search history.

(56) References Cited

U.S. PATENT DOCUMENTS

2004/0222890 A1* 11/2004 Yang ..... G08B 13/2434 340/572.9
2011/0273295 A1* 11/2011 Sayegh ..... G08B 13/2431 340/572.1
2015/0262462 A1* 9/2015 Nguyen ..... G08B 13/2434 340/572.9

* cited by examiner

*Primary Examiner* — Tai T Nguyen
(74) *Attorney, Agent, or Firm* — Fox Rothschild LLP; Robert J. Sacco; Carol E. Thorstad-Forsyth

(57) ABSTRACT

Systems (100) and methods (800) for operating a pin tag. The methods comprise: moving a first structure with a flange in a first direction; and sliding a chamfered surface of the flange against a chamfered surface of a second structure so as to move the second structure in a second direction away from the first structure. The second direction is angled relative to (e.g., perpendicular to) the first direction. Thereafter, the second structure is resiliently biased towards the first structure when the first structure has moved a certain distance in the first direction to a first position. The first structure is retained at the first position through an engagement of the second structure with the flange which is resiliently biased towards to the second structure in a third direction opposed from the first direction.

20 Claims, 6 Drawing Sheets

MODULAR AND ADAPTABLE SENSOR SYSTEM WITH INTEGRATED LOCK

FIELD OF THE INVENTION

This document relates generally to pin tags. More particularly, this document relates to systems and methods for providing a modular and adaptable sensor system with an integrated lock.

BACKGROUND OF THE INVENTION

Hard tags and sensors are currently used for loss prevention and asset tracking. Traditionally, these devices have appeared in various shapes and detacher platform configurations. The vast array of different hard tags and detaching methods sometimes makes it very difficult for a user to know why and/or when to use specific sensors (e.g., Electronic Article Surveillance ("EAS") sensors, Radio Frequency Identification ("RFID") sensors, alarming sensors, and/or store intelligence sensors). Moreover, most sensors include separate parts such as housings, pins and lanyards which further confuse the user. This confusion introduces usability and human factor problems when removing a hard tag or sensor from an article, which sometimes affects specific issues such as safety, customer experience and time (just to name a few).

These obstacles have proved to be very challenging and sometimes unavoidable when evolutions in the retail environment are considered (e.g., "self check-out"). Current solutions only consider the removal of hard tags and/or sensors by retail professionals. So, these current solutions are specifically not meant for the retail shopper's removal (especially during "self check-out").

Another problem exists when a sensor is used for "source tagging" at the point of manufacturing. Once again the current solutions sometimes consist of multiple parts, creating a possible slowdown in the attachment process.

SUMMARY OF THE INVENTION

The present document concerns implementing systems and methods for operating a pin tag. The methods comprise moving a first structure with a flange in a first direction. Movement of the first structure in the first direction causes movement of a pin in the first direction through an article insertion space formed in a housing of the pin tag. The article insertion space sized and shaped to prevent a user's access to the pin while the pin tag is being coupled to the article at least partially inserted into the article insertion space.

As the first structure is moved in the first direction, a chamfered surface of the flange slides against a chamfered surface of a second structure so as to move the second structure in a second direction away from the first structure. The second direction is angled (e.g., perpendicular) relative to the first direction. The second structure is resiliently biased towards the first structure when the first structure has moved a certain distance in the first direction to a first position. The first structure is retained in the first position through an engagement of the second structure with the flange which is resiliently biased towards to the second structure in a third direction opposed from the first direction.

In some scenarios, a magnetic field is applied to the pin tag so as to cause the second structure to move in the second direction away from the first structure whereby the first structure is no longer retained in the first position. The magnetic field can be applied to the pin tag as the pin tag is being inserted into or pulled into a kiosk. Notably, a portion of an article secured to the pin tag is located at a first end of the pin tag that is opposed from a second end of the pin tag in which the second structure is disposed. In effect, the article does not interfere with the decoupling of the pin tag therefrom via the kiosk. The application of the magnetic field to the pin tag is discontinued so that the second structure is once again resiliently biased toward the first structure.

In those or other scenarios, a sensor unit is coupled to the pin tag by sliding at least one structure protruding out and away from the sensor unit's housing into a mating channel formed in the pin tag's housing. The sensor unit may be interchangeable with other sensor units. In this case, a housing of a first sensor unit is interchangeably coupled to a housing of the pin tag. The first sensor unit is exchanged with a second senor unit employing a sensor technology that is different than the first sensor unit's sensor technology. The sensor technology of the first or second sensor unit comprises EAS technology, Short Range Communication ("SRC") technology, and alarming technology. Tracking operations can be performed to track which sensor units of a plurality of sensor units are interchangeably coupled to the pin tag during a given period of time.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
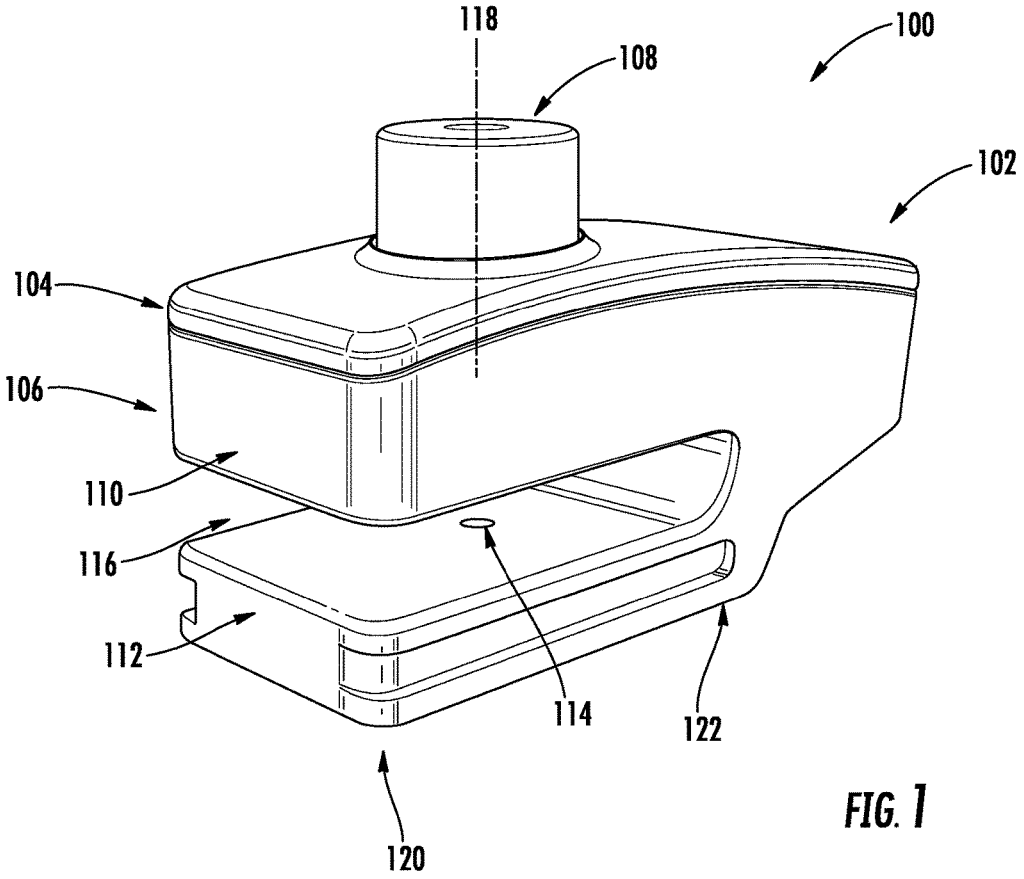
FIG. 1 is a schematic illustration of an exemplary illustration of a pin tag in an unengaged state.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

A one piece, modular system can help provide a more refined, effective and organized solution. Accordingly, the present document concerns systems and methods for providing a Modular and Adaptable Sensor ("MAS") system with an integrated securement mechanism (e.g., a lock). The MAS system provides the ability to reinforce a number of advantages as compared to the current hard tag and sensor solutions. With the use of a single platform having an integrated locking solution, some of the current obstacles are removed so as to (a) enable self check-out and (2) expedite and simplify some of the current attachment and removal processes (both manual and automated).

The MAS system comprises a one piece tag/sensor. This configuration provides a more refined solution for the user and customer. This new single platform improves human factors and usability (easier installation and removal), safety (hidden pin), increased throughput and faster checkout (less parts). This single platform is also better suited for high speed installation at a manufacturing facility (visible source tagging) and enables customer self check-out.

Figure 2:
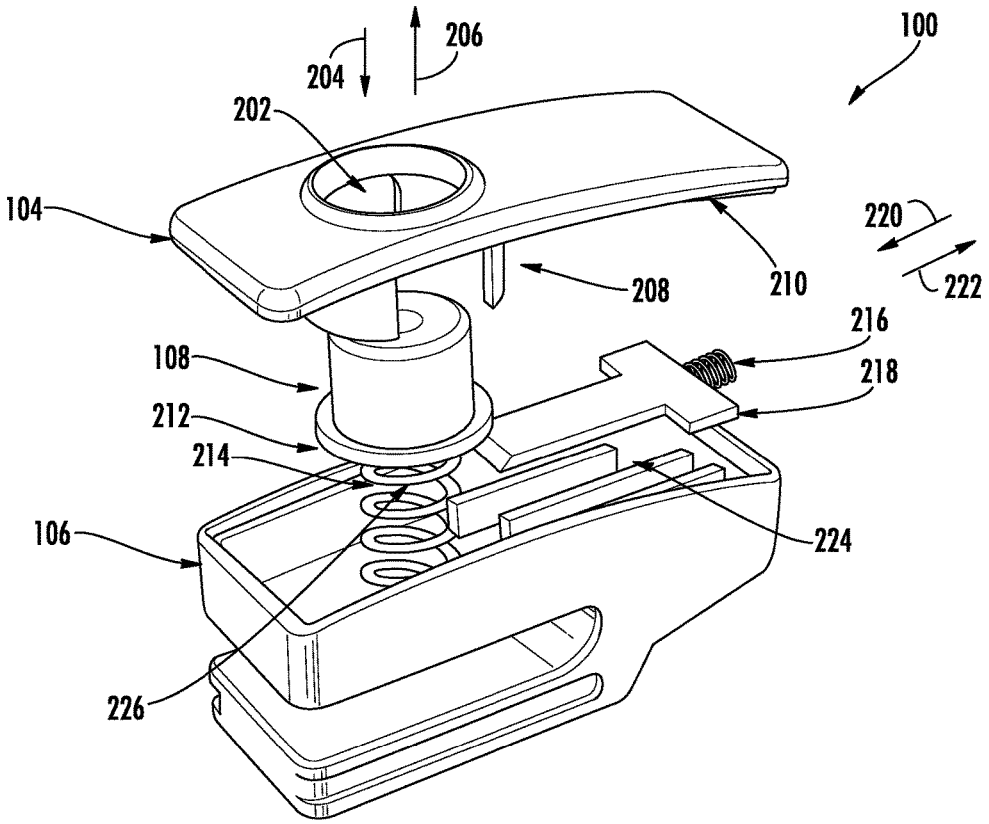
FIG. 2 is an exploded view of the pin tag shown in FIG. 1.
Figure 3:
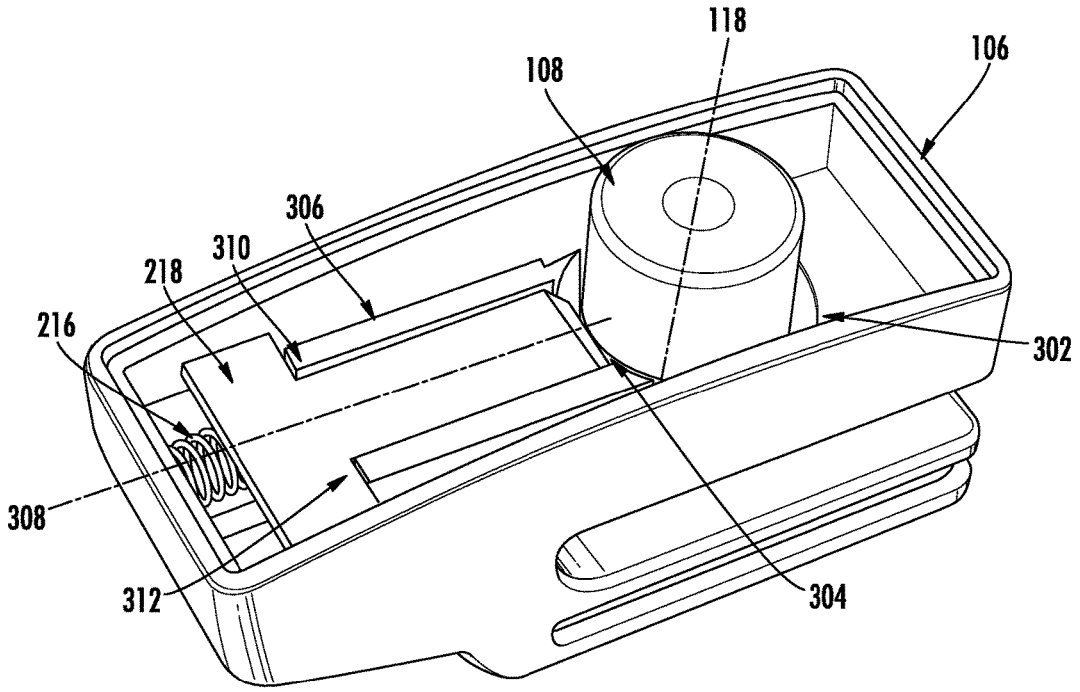
FIG. 3 is an illustration of the pin tag shown in FIG. 1 with a top housing portion removed therefrom.

Referring now to FIGS. 1-3, there is provided schematic illustrations that show an exemplary architecture for a pin tag 100. The pin tag 100 is generally configured to be removably secured to an article, such as a piece of clothing. In this regard, the pin tag 100 comprises a housing 102 in which various securement components 108-116 are at least partially disposed. The securement components reside between a top housing portion 104 and a bottom housing portion 106.

The top housing portion 104 has an aperture 202 formed therethrough for receiving a button 108 of the securement components. The button 108 is arranged such that it can slidingly move through the aperture 202 in a first direction 204 when depressed and in a second opposing direction 206 when released. At least one protrusion 208 extends from a bottom surface 210 of the top housing portion 104 for purposes of providing a structural guide for the button 108 as it moves in directions 204, 206 along its center axis 118. In effect, the button 108 remains aligned along its center axis 118 despite actuation and/or engagement thereof by a person and/or other object in one or more directions. The button 118 also remains aligned along its center axis when the pin tag is dropped or shaken.

A pin 226 of the securement components is integrated with or coupled to a bottom surface 212 of the button 108 so that the pin can be selectively inserted through and removed from the article via actuation of the button. Accordingly, the pin 226 is disposed within the housing 102 of the pin tag 100 when the button 108 is in its undepressed state, as shown in FIG. 1. In contrast, the pin 226 extends through (a) a first aperture (not visible in FIGS. 1-3) formed through a first portion 110 of the bottom housing portion 106, (b) an article insertion space 116 formed in the bottom housing portion 106, and (c) a second aperture 114 formed through a second portion 112 of the bottom housing portion 106 when the button 108 is in it depressed state (shown in FIGS. 4-6). In effect, the pin tag 100 can be securely coupled to the article via the pin 226.

The article insertion space 116 is designed so that: (1) an article of interest is able to be at least partially received therein so that the pin 226 can be inserted through the same; and at least an adult human cannot be injured by the pin 226 during the coupling of the pin to the article. In some scenarios, the article insertion space 116 is sized and shaped (e.g., as a slot or slit in the bottom housing portion 106) so that an adult human cannot slide his(her) fingers or other appendages therein, thereby ensuring the safety of users. Notably, the article insertion space 116 advantageously has (1) an elongate profile with an orientation that is perpendicular to the central axis of the button 118, and (2) a location at a first end 120 of the pin tag 100 that is opposed from a second end 122 of the pin tag 100 in which other elements 216, 218 of the securement components are disposed. The importance of this arrangement will become evident as the discussion progresses.

As shown in FIGS. 2-3, the securement components also include resilient elements 214, 216 and a retention element 218. Resilient element 214 is normally in an uncompressed state with a slight pre-load whereby it applies an upward force to the button 108 (i.e., the button is resiliently biased in direction 206 by resilient element 214). The resilient element 214 is in a compressed state when the button 108 is in its depressed state. The resilient element 214 returns to its uncompressed state when the button 108 is released. As the resilient element 214 returns to its uncompressed state, it applies an upward force against (or resiliently biases) the button 108 so that the button 108 is mechanically returned to its undepressed state. In some scenarios, the resilient element 214 comprises a spring in which the pin 226 is disposed along the spring's center axis.

Resilient element 216 and retention element 218 collectively provide an exemplary latching means for retaining the button 108 in its depressed state during a given period of time. In some scenarios, the resilient element 216 comprises a spring that is normally in an uncompressed state (shown in FIG. 3). In this uncompressed state, the resilient element 216 applies a pushing force to the retention element 218 in a direction 220. The retention element 218 engages a flange 302 of the button 108 when the resilient element 216 applies the pushing force thereto. This engagement results in the retention of the button 108 in its depressed state (shown in FIG. 3) since movement of the button in direction 206 is prevented by the retention element 218 (which is resiliently biased in direction 220 by resilient element 216).

Resilient element 216 and retention element 218 also collectively provide a means for selectively releasing the button 108 at a desired time. In this regard, at least the retention element 218 is formed of a ferrous material such that when a magnetic field is applied thereto by an external tag detacher the retention element 218 travels in direction 222 away from button 108. External tag detachers are well known in the art, and therefore will not be described herein. Any known or to be known tag detacher can be used herein without limitation. As the retention element 218 travels in direction 222, the resilient element 216 transitions from its uncompressed state to its compressed state and the button 108 transitions from its depressed state (shown in FIG. 3) to its undepressed state (shown in FIG. 1).

When the magnetic field is no longer being applied to the pin tag 100, the resilient element 216 pushes the retention element 218 in direction 220 until the resilient element 216 reaches its fully uncompressed state. At this time, a chamfered surface 304 of the retention element 218 resides below bottom surface 212 of the button 108. The bottom surface 212 is a sloping or angled surface (not visible in FIGS. 1-3) that engages the chamfered surface 304 as the button 108 is depressed. This engagement causes the bottom surface 212 of the button 108 to slide against the chamfered surface 304 of the retention element 218, whereby the retention element 218 is caused to slide in direction 222 away from the button 108. Once the button 108 is fully depressed, the resilient element 216 forces the retention element 218 to travel in a direction 220 towards the button 108 for securely retaining the button 108 in its depressed state.

One or more support structures 224 are disposed or formed in the bottom housing portion 106 for providing a desired height relationship between the retention element 218 and the button 108. Additionally, one or more guide structures 306 are disposed or formed in the bottom housing portion 106 for ensuring the continuous desired alignment and orientation of the retention element 218 in relation to the button 108. The support and guide structures 224, 306 may include protrusions integrally formed with the bottom housing portion 106 during a molding process. In some scenarios, the support structures 224 also act as guides for the retention element's movement.

The shape and size of the retention element 218 is also selected to facilitate said alignment and orientation thereof. For example, the retention element 218 may have a generally T-shape as shown in FIGS. 2-3. In this case, surfaces 312 of the retention element 218 are arranged to engage surfaces 310 of the guide structures 306 when the retention element 218 travels a certain distance in direction 220. This engagement limits the retention element's total travel distance along an axis 308 in direction 220.

Notably, a center axis 308 of the retention element 218 is arranged to be perpendicular or angled relative to the center axis 118 of the button 108. As such, the directions of travel 220, 222 for the retention element 218 are perpendicular or angled relative to the directions of travels 204, 206 for the button 108. This is an important feature of the pin tag 100 that distinguishes the pin tag 100 from conventional security tags in which the retention element (spring and/or button) travels in opposing directions aligned with the center axis of the button. This feature also enables a user to insert the pin tag 100 into a novel tag detacher whereby the pin tag 100 is removed seamlessly and automatically from the article (as described below) and placed in a storage container during a self check-out process. This seamless and automatic process during a self check-out process is not possible using conventional security tags.

The architecture of the pin tag is not limited to the architecture shown in FIGS. 1-3. For example, a ferrous latching means may be employed that has a different configuration than that shown in FIGS. 1-3. Also, the housing may have a different overall shape than that shown in FIGS. 1-3.

Figure 4:
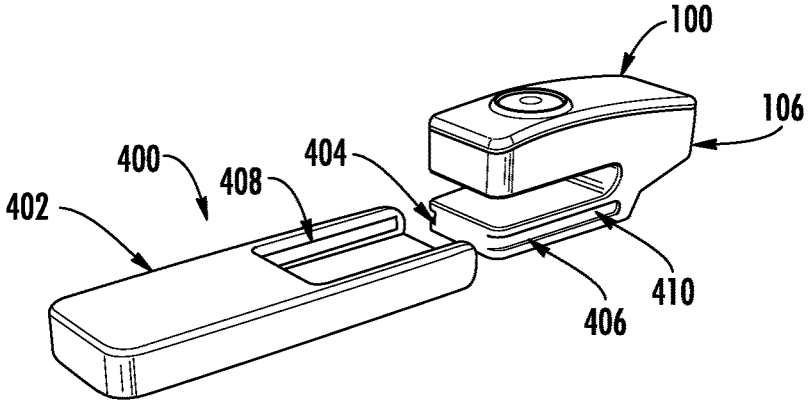
FIGS. 4-5 provide illustrations that are useful for understanding how a security element is coupled to the pin tag of FIG. 1.
Figure 5:
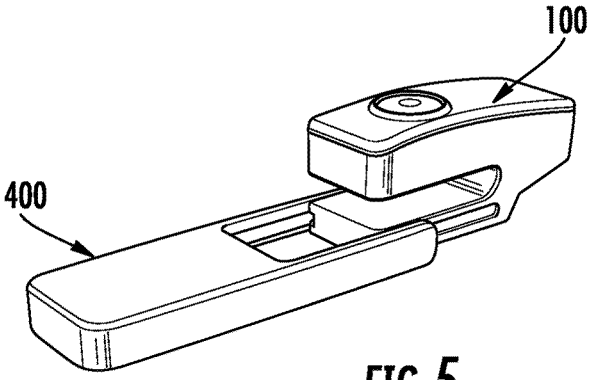
Figure 6:
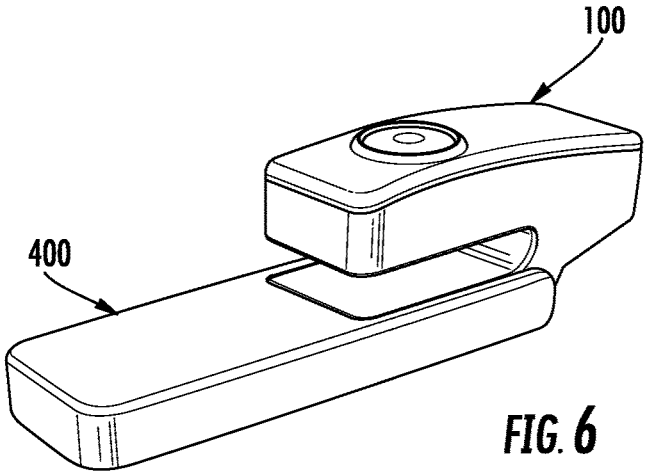
FIG. 6 is an illustration of a security element coupled to the pin tag of FIG. 1.

Referring now to FIGS. 4-6, there are provided schematic illustrations that are useful for understanding how the pin tag 100 can be coupled to a sensor unit 400. The sensor unit 400 comprises a housing 402 in which at least one sensor is disposed. The sensor can be of any technology selected in accordance with a particular application. For example, in an Electronic Article Surveillance ("EAS") application, the sensor comprises an EAS element, an RFID element, and/or an alarming element. In inventory tracking applications, the sensor comprises an SRC element and/or an alarming element to facilitate one in locating a particular item or tag. EAS, RFID, SRC and alarming elements are well known in the art, and therefore will not be described herein. Any known or to be known EAS, RFID, SRC and/or alarming element can be used herein without limitation.

In some scenarios, the sensor unit 400 is securely coupled to the pin tag 100. In this case, protrusions 408 of sensor unit 400 are slidingly received in mating channels 404, 406 of the pin tag 100. The secure coupling of the two components 100, 400 can be achieved using a variety of coupling techniques, such as a friction based coupling technique, an adhesive based coupling technique, and/or a mechanical structure based coupling technique. The mechanical structure may include a snap coupler (e.g., a detent and notch arrangement).

However, in other scenarios, the sensor unit 400 is interchangeable so that the sensor technology is configurable by a user, i.e., sensor units employing different sensor technologies can be coupled to the same pin tag 100 at subsequent times. In this case, protrusions 408 of sensor unit 400 can also be slidingly received in mating channels 404, 406 of the pin tag 100. The coupling of the two components 100, 400 can be achieved using a variety of coupling techniques, such as a friction based coupling technique and a mechanical structure based coupling technique.

For example, the mechanical structure may include a tool and screw. Additionally or alternatively, the mechanical structure may include at least one ferrous pin/spring element for selectively coupling and decoupling the sensor unit 400 from the pin tag 100. The ferrous pin/spring element protrudes out and away from at least one protrusion 408 of the sensor unit 400. The ferrous pin has a chamfered end so that the pin compresses the spring when the protrusions 408 are slide into mating channels 404, 406 of the pin tag 100. An aperture is formed in a surface 410 of a channel 404, 406 so that when the protrusions 408 have traveled a certain distance towards the pin tag 100 the pin is resiliently pushed into the aperture by the spring. The ferrous pin can be subsequently removed from the aperture via application of a magnetic field thereto. The present invention is not limited to the particulars of this example.

In the interchangeable sensor unit applications, operations can be performed to track which sensor unit of a plurality of sensor units is attached to a particular pin tag. Such operations can include, but are not limited to: acquiring unique codes from the sensor unit and pin tag using SRCs; communicating the unique codes to a remote database for storage therein so as to be associated with each other; and storing a timestamp in the remote database indicating when the unique codes where acquired and/or the stored. Information may also be stored that indicates: when and if the pin tag is coupled to an article; when and if the pin tag is decoupled from an article; which kiosk detacher of a plurality of kiosk detacher was used to decouple the pin tag from the article; and/or whether the pin tag and/or sensor unit are still operational or broken.

Referring now to FIGS. 7A-7E, there is provided schematic illustrations that are useful for understanding how the pin tag 100 can be automatically and seamlessly decoupled from an article. The pin tag 100 is decoupled from an article using a kiosk detacher 700. The kiosk detacher 700 comprises a display screen 702 (e.g., used for operator interfacing and feedback) and a trap door 704. The trap door 704 opens when a successful purchase transaction of an article to which the pin tag 100 is attached is verified. Techniques for verifying the successful purchase transaction are well known in the art, and therefore will not be described herein. Any known or to be known technique for verifying a purchase transaction's success can be used herein without limitation. In some scenarios, unique identifiers of the pin tag and/or article are compared to a transaction list of purchased articles. The unique identifiers can be acquired using SRC technology (including Bluetooth, RFID, and/or barcode scanning).

Figure 7A:
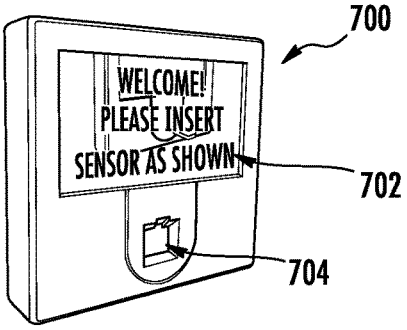
FIGS. 7A-7E provide illustrations that are useful for understanding how the pin tag of FIG. 1 can be decoupled from an article and retrieved from a person for later reuse.
Figure 7B:
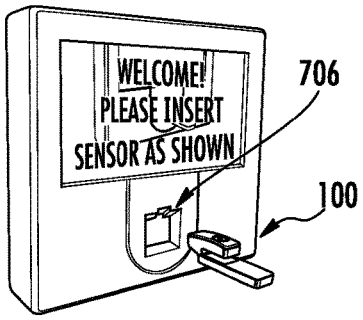
Figure 7C:
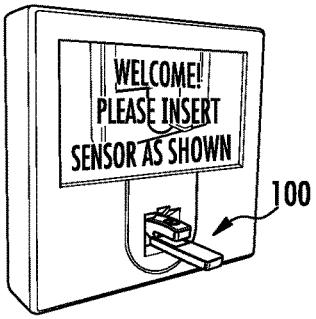
Figure 7D:
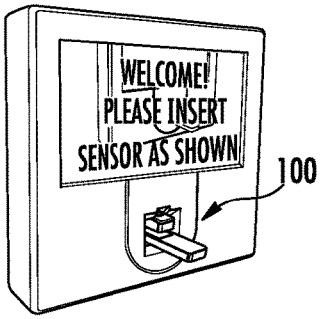
Figure 7E:
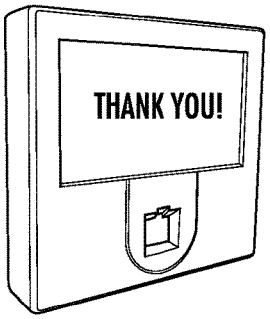

After the trap door opening, the pin tag 100 can be inserted into an insert space 706 formed in the housing of the kiosk, as shown in FIGS. 7B-7D. As the pin tag 100 is being inserted into the insert space 706, a mechanical mechanism inside the kiosk and the magnetic properties of the detacher unit causes the pin tag 100 to be pulled into the kiosk while a magnetic field is applied thereto, whereby the pin tag 100 seamlessly slides away from the released article. In some scenarios, the mechanical mechanism incudes, but is not limited to, a rotating arm, a grasper, a clamp, gears, a track, and/or wheels. Once the pin tag 100 is pulled a certain amount into the kiosk, it is directed to a storage container for later retrieval and/or use. The storage container may be a locked or unlocked container. In either scenario, the contents of the storage container can be monitored such that an alarm is issued by the kiosk when the storage container becomes filled to a desire amount/volume.

It is important to note the location of an article relative to the retention element 218 as the pin tag 100 is being inserted into the kiosk. The portion of the article that is pierced by the pin 226 is horizontally aligned with the elongate body of the retention element 218. Consequently, the article is released without interfering with the insertion and pulling of the pin tag into the kiosk. This feature of the present invention is also facilitated by the relative angled orientations of the button's movement and the retention element's movement, i.e., the retention element moves in two opposing directions that are angled with respect to (e.g., perpendicular to) the two opposing directions of the button's movement.

Figure 8:
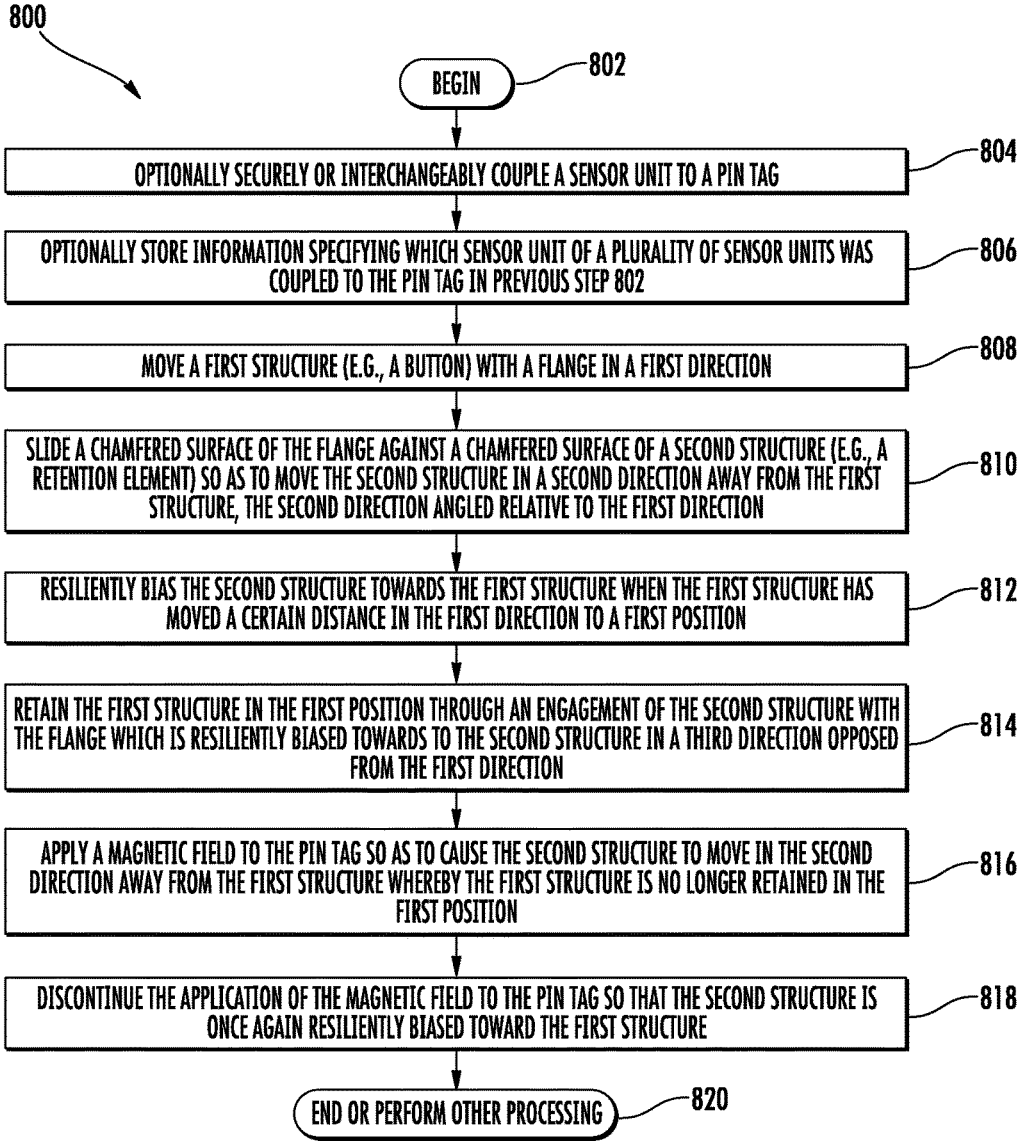
FIG. 8 is a flow diagram of an exemplary method for operating a pin tag.

Referring now to FIG. 8, there is provided a flow diagram of an exemplary method 800 for operating a pin tag (e.g., pin tag 100 of FIGS. 1-6). The method 800 begins with step 802 and continues with optional steps 804-806. Optional steps 804-806 can be performed to implement a sensor technology suitable for a particular application. The sensor technology can include, but is not limited to, EAS technology, SRC technology, and alarming technology.

As shown in FIG. 8, optional steps 804-806 involve: optionally securely or interchangeably coupling a sensor unit (e.g., sensor unit 400 of FIG. 4) to the pin tag; and optionally storing information specifying which sensor unit of a plurality of sensor units was coupled to the pin tag. In some scenarios, the sensor unit is coupled to the pin tag by sliding at least one structure (e.g., structure 408 of FIG. 4) protruding out and away from the sensor unit's housing (e.g., housing 402 of FIG. 4) into a mating channel (e.g., mating channel 404 or 406 of FIG. 4) formed in the pin tag's housing.

Upon completing step 802 or 806, the method 800 continues with step 808 where a first structure (e.g., button 108 of FIG. 1) with a flange (e.g., flange 302 of FIG. 3) is moved in a first direction (e.g., direction 204 of FIG. 2). Notably, the movement of the first structure in the first direction causes movement of a pin (e.g., pin 226 of FIG. 1) in the first direction through an article insertion space (e.g., article insert space 116 of FIG. 1) formed in a housing (e.g., housing 102 of FIG. 1) of the pin tag. The article insertion space is sized and shaped to prevent a user's access to the pin while the pin tag is being coupled to the article at least partially inserted into the article insertion space.

Next in step 810, a chamfered surface of the flange is slid against a chamfered surface (e.g., chamfered surface 304 of FIG. 3) of a second structure (e.g., the retention element 218 of FIG. 2) so as to move the second structure in a second direction (e.g., direction 222 of FIG. 2) away from the first structure. The second direction is angled relative to (e.g., perpendicular to) the first direction. The second structure is resiliently biased towards the first structure when the first structure has moved a certain distance in the first direction to a first position, as shown by step 812. This resilient biasing can be achieved using a resilient element (e.g., resilient element 216 of FIG. 2) such as a spring. The first structure is retained in the first position through an engagement of the second structure with the flange, as shown by step 814. The flange is resiliently biased towards to the second structure in a third direction (e.g., direction 206 of FIG. 2) opposed from the first direction. This resilient biasing can also be achieved using a resilient element (e.g., resilient element 214 of FIG. 2) such as a spring.

At some later time, step 816 is performed where a magnetic field is applied to the pin. In effect, the second structure is caused to move in the second direction away from the first structure, whereby the first structure is no longer retained in the first position. In some scenarios, the magnetic field is applied to the pin tag as the pin tag is being inserted into or pulled into a kiosk (e.g., kiosk 700 of FIG. 7A). Notably, a portion of an article secured to the pin tag is located at a first end of the pin tag that is opposed from a second end of the pin tag in which the second structure is disposed. As such, the article does not interfere with the pin tag's seamless and automatic decoupling by the kiosk. Also, the article remains in the user's possession while the pin tag is being pulled into the kiosk and when the pin tag is fully disposed within the kiosk. Essentially, the pin tag is seamlessly decoupled and pulled away from the article by the kiosk without any human intervention. The present invention is not limited to the particulars of the kiosk scenarios. Once the pin tag has been decoupled from the article, the application of the magnetic field is discontinued as shown by step 818. In effect, the second structure is once again resiliently biased toward the first structure. Subsequent to completing step 818, step 820 is performed where method 800 ends or other processing is involved.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

I claim:

1. A method for operating a pin tag, comprising:

moving a first structure with a flange in a first direction;

sliding a chamfered surface of the flange against a chamfered surface of a second structure so as to move the second structure in a second direction away from the first structure, the second direction angled relative to the first direction;

resiliently biasing the second structure towards the first structure when the first structure has moved a certain distance in the first direction to a first position; and retaining the first structure in the first position through an engagement of the second structure with the flange which is resiliently biased towards to the second structure in a third direction opposed from the first direction.

2. The method according to claim 1, wherein movement of the first structure in the first direction causes movement of a pin in the first direction through an article insertion space formed in a housing of the pin tag, the article insertion space sized and shaped to prevent a user's access to the pin while the pin tag is being coupled to the article at least partially inserted into the article insertion space.

3. The method according to claim 1, further comprising applying a magnetic field to the pin tag so as to cause the second structure to move in the second direction away from the first structure whereby the first structure is no longer retained in the first position.

4. The method according to claim 3, wherein the magnetic field is applied to the pin tag as the pin tag is being inserted into or pulled into a kiosk.

5. The method according to claim 4, wherein a portion of an article secured to the pin tag is located at a first end of the pin tag that is opposed from a second end of the pin tag in which the second structure is disposed.

6. The method according to claim 3, further comprising discontinuing the application of the magnetic field to the pin tag so that the second structure is once again resiliently biased toward the first structure.

7. The method according to claim 1, further comprising coupling a sensor unit to the pin tag by sliding at least one structure protruding out and away from the sensor unit's housing into a mating channel formed in the pin tag's housing.

8. The method according to claim 1, further comprising:

coupling a housing of a first sensor unit to a housing of the pin tag; and exchanging the first sensor unit with a second senor unit employing a sensor technology that is different than the first sensor unit's sensor technology.

9. The method according to claim 8, wherein the sensor technology of the first or second sensor unit comprises Electronic Article Surveillance ("EAS") technology, Short Range Communication ("SRC") technology, and alarming technology.

10. The method according to claim 8, further comprising tracking which sensor units of a plurality of sensor units are interchangeably coupled to the pin tag during a given period of time.

11. The method according to claim 1, wherein the second direction in which the second structure moves is perpendicular to the first direction in which the first structure moves.

12. A system, comprising:

a pin tag having a first structure with a flange that is movable in a first direction, the flange having a chamfered surface that is slidable against a chamfered surface of a second structure so as to move the second structure in a second direction away from the first structure, the second direction angled relative to the first direction, a resilient element resiliently biasing the second structure towards the first structure when the first structure has moved a certain distance in the first direction to a first position, and wherein the first structure is retained in the first position through an engagement of the second structure with the flange which is resiliently biased towards to the second structure in a third direction opposed from the first direction.

13. The system according to claim 12, wherein movement of the first structure in the first direction causes movement of a pin of the pin tag in the first direction through an article insertion space formed in a housing of the pin tag, the article insertion space sized and shaped to prevent a user's access to the pin while the pin tag is being coupled to the article at least partially inserted into the article insertion space.

14. The system according to claim 12, wherein a magnetic field is applied to the pin tag so as to cause the second structure to move in the second direction away from the first structure whereby the first structure is no longer retained in the first position.

15. The system according to claim 14, wherein the magnetic field is applied to the pin tag as the pin tag is being inserted into or pulled into a kiosk.

16. The system according to claim 15, wherein a portion of an article secured to the pin tag is located at a first end of the pin tag that is opposed from a second end of the pin tag in which the second structure is disposed.

17. The system according to claim 14, wherein the application of the magnetic field to the pin tag is discontinued so that the second structure is once again resiliently biased toward the first structure.

18. The system according to claim 12, further comprising a sensor unit that is coupled to the pin tag by sliding at least one structure protruding out and away from the sensor unit's housing into a mating channel formed in the pin tag's housing.

19. The system according to claim 12, further comprising:

a first sensor unit having a housing coupled to a housing of the pin tag; and wherein the first sensor unit is interchangeable with a second senor unit employing a sensor technology that is different than the first sensor unit's sensor technology.

20. The system according to claim 19, wherein the first and second sensor units comprise unique identifiers associated therewith which are used to track which sensor unit is interchangeably coupled to the pin tag during a given period of time.

* * * * *